US005268728A

United States Patent [19]

Sugiyama et al.

[11] Patent Number: 5,268,728

[45] Date of Patent: Dec. 7, 1993

[54] IMAGE FORMING APPARATUS WITH INTERMEDIATE TRAY

[75] Inventors: Tsukasa Sugiyama, Moriguchi; Ken Yoshizuka, Nagaokakyo, both of Japan

[73] Assignee: Mita Industrial Co., Inc., Osaka, Japan

[21] Appl. No.: 848,927

[22] Filed: Mar. 10, 1992

[30] Foreign Application Priority Data

Mar. 11, 1991 [JP] Japan ..... 3-044870

[51] Int. Cl.[5] ..... G03G 21/00

[52] U.S. Cl. ..... 355/319; 271/259; 355/205

[58] Field of Search ..... 355/205, 208, 308, 309, 355/316, 206, 207, 209, 318, 319, 320, 323; 271/9, 259, 263

[56] References Cited

U.S. PATENT DOCUMENTS

| | | | |
|---|---|---|---|
| 4,692,022 | 9/1987 | Iwai | 355/319 X |
| 4,772,917 | 9/1988 | Tani | 355/319 X |
| 4,816,872 | 3/1989 | Okamoto et al. | 355/319 X |
| 4,851,876 | 7/1989 | Yamamoto et al. | 355/323 |
| 4,963,946 | 10/1990 | Maruta et al. | 355/308 |
| 5,010,363 | 4/1991 | Higashio et al. | 355/207 X |
| 5,081,490 | 1/1992 | Wakao | 355/309 X |
| 5,105,229 | 4/1992 | Ozaki | 271/9 X |

*Primary Examiner*—Leo P. Picard
*Assistant Examiner*—Christopher Horgan
*Attorney, Agent, or Firm*—Beveridge, DeGrandi, Weilacher & Young

[57] ABSTRACT

If a being conveyed on which the image of a preceding document of a specific document is formed is jammed on the way including the post-processing device for post-processing while a new paper is fed from a paper feeder for the specific document and being sent into the intermediate tray by conveyer, the controller stops the conveyance of the jamming paper by the conveyer, and allows the paper being towards the intermediate tray to be conveyed to the intermediate tray and stocked, while stopping feed of new paper by paper feeder, and when jamming is cleared, the paper stocked in the intermediate tray is discharged outsides.

4 Claims, 3 Drawing Sheets

IMAGE FORMING APPARATUS WITH INTERMEDIATE TRAY

BACKGROUND OF THE INVENTION

1. Field of the Invention

The present invention relates to an image forming apparatus with an intermediate tray, such as a copier. More particularly, the invention relates to a copier possessing an intermediate tray for making two-sided copies or synthetic copies, and also possessing a sorter or other post-processing device.

2. Description of the Related Art

Hitherto, in a copier provided with a sorter, when making a two-sided copy from a first document (manuscript), the images are formed sequentially on the face side of a paper in the number of copies required, and the copies then are stocked on an intermediate tray. Then the document is inverted, and the sheets of paper copied on one side are taken out one by one from the intermediate tray, and images are sequentially formed on the reverse side. The sheets are sent into the sorter and sorted, while the next document is set on the contact glass at the same time, in order for the image forming apparatus to operate at high speed. The images are formed from the second document in the same manner as in the case of the first document.

Incidentally, in the high speed copier for copying the next document while sorting with the sorter, when the sheets being sorted by the sorter are jammed, the copied sheets of the next document already may be moving toward the intermediate tray, after the copying on one side of the copy paper is finished.

In such a case, if the copied sheets of the next document are sent directly into the intermediate tray, it is necessary to remove the jammed paper, set the initial document again on the contact glass, and copy it. Therefore, the copied paper of the next document and the copied paper of the initial document coexist in the intermediate tray, and the subsequent copy procedure is difficult.

To avoid this problem, in known apparatuses, if jamming occurs in the sorter, the entire apparatus is stopped, assuming that the jamming has occurred at the copier main body, whether the copy paper of the next document is jammed or not.

In such a conventional method, however, if the sorter is jammed, the copier main body is also considered to be jammed, although it is not actually jammed, and a jam clearing operation is needed at two positions, which takes time and labor.

SUMMARY OF THE INVENTION

It is a primary object of the invention to offer an image forming apparatus with an intermediate tray wherein the jam clearing procedure is simplified in the light of the problems of the above-mentioned conventional image forming apparatus.

To achieve the above object, the present invention is an image forming apparatus with an intermediate tray comprising:

paper feeding means for feeding a paper, conveying means for conveying the paper, image forming means for image forming using an intermediate tray, post-processing device for post-processing the paper with the image formed thereon, jamming detecting means for detecting jamming of the paper, and control means for controlling the apparatus in a manner such that if the paper being conveyed (on which paper an image of a preceding document of a specific document is formed) is jammed on its way, for example, to the post-processing device, while a new paper is fed from the paper feeding means for the specific document and is being sent into the intermediate tray by the conveying means, then a conveyance of the jammed paper by the conveying means is stopped, and the paper being moved toward the intermediate tray is allowed to be conveyed to the intermediate tray and stocked. At this time, the feeding of a new paper by the paper feeding means is stopped, and when the jam is cleared, the paper stocked in the intermediate tray is discharged outside of the image forming apparatus.

In the invention, if a paper is being conveyed on which the image of a preceding document of a specific document is formed, and this paper is jammed on the way, including on the way to the post-processing device for post-processing, while a new paper is fed from the paper feeding means for the specific document and is being sent into the intermediate tray by the conveying means, then the control means stops the conveyance of the jammed paper by the conveying means, and allows the paper being moved toward the intermediate tray to be conveyed to the intermediate tray and stocked. At this time, the feeding of new paper by the paper feeding means is stopped, and when the jammed paper is cleared, the paper stocked in the intermediate tray is discharged outside of the image forming apparatus.

DESCRIPTION OF THE PREFERRED EMBODIMENTS

Figure 1:
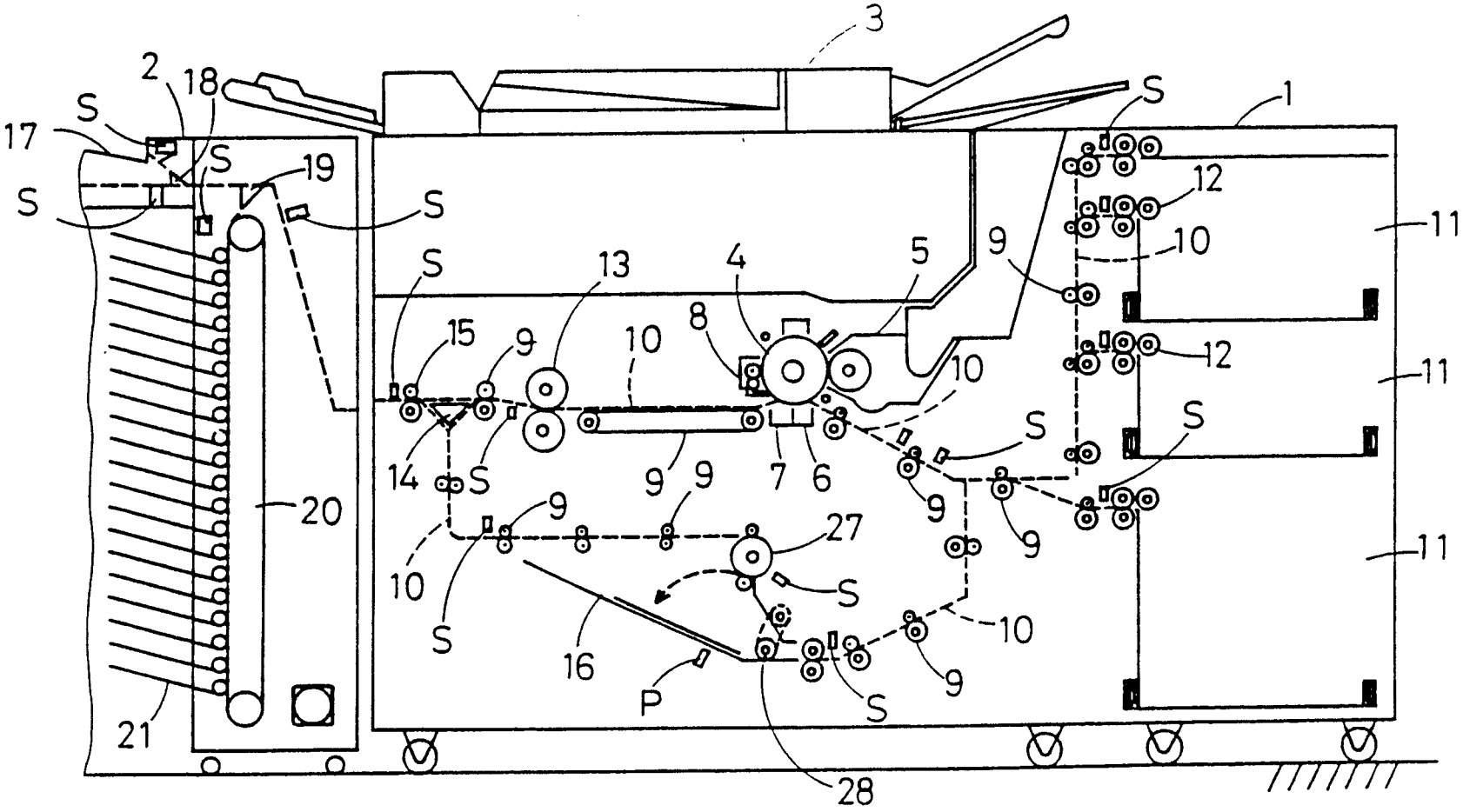
FIG. 1 is a schematic sectional view showing a part of an embodiment of an image forming apparatus with an intermediate tray in accordance with the present invention.

Referring now to the drawings, an embodiment of the invention is described below.

Figure 2:
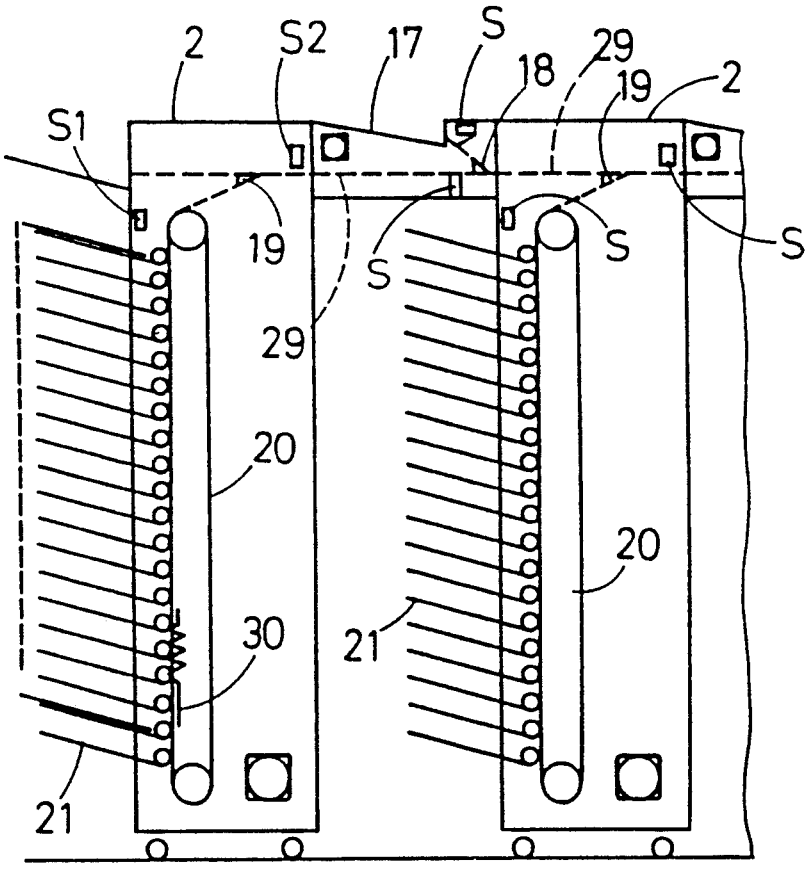
FIG. 2 is a schematic sectional diagram showing the rest of the embodiment of the image forming apparatus with an intermediate tray in accordance with the present invention.

FIG. 1 and FIG. 2 are sectional views of a copier incorporating an embodiment of an image forming apparatus with an intermediate tray according to the present invention.

In both drawings, above a contact glass of a copier main body 1, an ADF 3 is installed for mounting the documents automatically on the contact glass. The central area of the copier main body 1 is occupied by some image forming means, such as a photoreceptor 4 on which latent images are formed, a developer 5 for making latent images visible by toner, a transfer device 6 for transferring the toner images onto the paper, a separator 7 for separating the transferred paper from the photoreceptor 4, a cleaner 8 for cleaning the residual toner from the photoreceptor 4, a thermal fixing device 13 for thermally fixing the toner images onto the separated paper, and so on. In the drawings, reference numeral 9 is a conveying means for conveying paper, comprising: belt, roller and others. Furthermore, reference numeral 10 shows the conveying route. At the right side of the copier main body 1, a paper feeding means 11 is disposed, such as a paper feed deck, for feeding paper. Reference numeral 12 is a roller for feeding paper.

The conveying route 10 starts from the paper feed mean 11 and leads to the discharge roller 15 by way of the transfer device 6, separator 7, thermal fixing device 13, and changeover pawl 14. The route 10 goes downward from the changeover pawl 14 as indicated by the dotted line, bends to the right, then bends downward along the roller 27 and falls into the intermediate tray 16. From the intermediate tray 16, the conveying route 10 goes to the right, bends upward, joins with the conveying route 10 from the paper feed means 11, and continues toward the transfer device 6. In each conveying route 10, paper detection sensors S are installed, such as photo sensors, for detecting the passing of paper at respective positions. The intermediate tray 16 has a sensor P for detecting whether or not paper is present in the intermediate tray 16.

On the other hand, on the left side of the copier main body 1, a triple sorter 2 is installed for sorting the paper discharged from the discharge roller 15. Numeral 17 is a tray for stocking unsorted papers. Numeral 19 is a changeover pawl for feeding paper into each sorter 2, and 18 is a pawl for changing whether or not to sort the paper to be sent into each sorter. Numeral 20 is a belt for feeding the paper into each bin tray 21.

Figure 3:
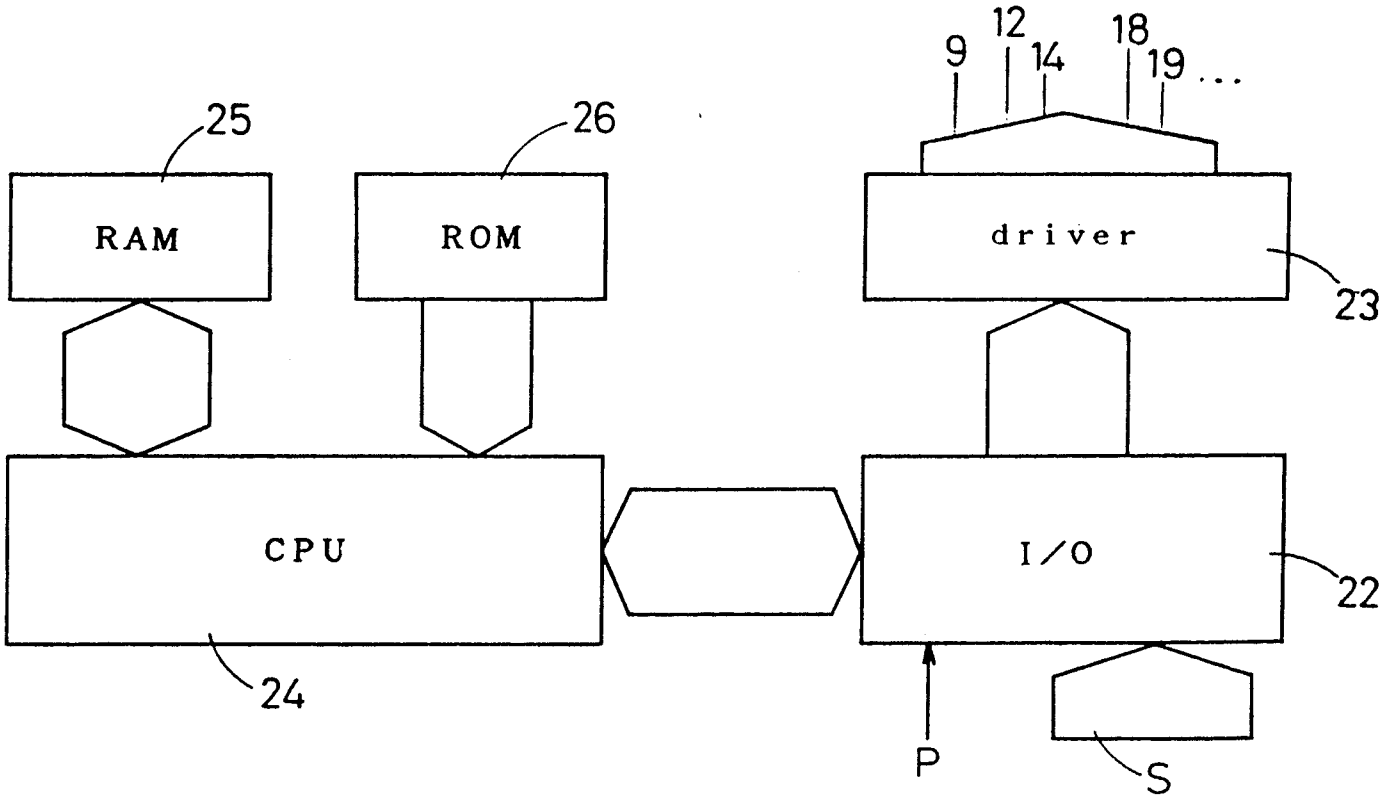
FIG. 3 is a block diagram showing the control relation in the same embodiment of the image forming apparatus.

Next, the constitution of this embodiment is explained from the aspect of the controller, with reference to FIG. 3.

A central processing unit (CPU) 24 of a microcomputer is an example of a control means. The control means receives detection signals from the sensor P for detecting the presence or absence of the paper in the intermediate tray 16, and from the sensors S for detecting the passing of the paper in the conveying routes 10, through an interface 22. As described below in relation to the description about the operation of the image forming apparatus, the CPU 24 is responsible for various controls. Numeral 25 is a RAM used for a job memory or the like, and 26 is a ROM for storing the program for various controls. The driver 23 receives instruction signals from the CPU 24 through the interface 22, thereby driving the conveying roller 9, paper feed roller 12, changeover pawl 14, belt 20, and others, according to these instruction signals.

The operation of the above embodiment is described below.

A plurality of documents are set in the ADF 3. As an example, the number of copies of ten is entered through a numeric key pad of the operation panel. The document is read by the scanning of the optical system, and the photoreceptor 4 is exposed and developed by the developer 5. At the same time, a sheet is taken out from the paper feed means 11, and is sent into the transfer device 6 through the conveying route 10. The transfer device 6 transfers the toner image on the photoreceptor 4 to one side of the paper. The paper is separated by the separator 7, and is moved along the conveying route 10. After being fixed by the thermal fixing device 13, the paper is moved downward by the changeover pawl 14. At the roller 27, the paper is inverted and dropped into the intermediate tray 16 and stocked. The other nine copies are made in a similar manner.

Consequently, the document is inverted by the inverting device of the ADF 3, and is put again on the contact glass. The document is scanned by the optical system and exposed. From the intermediate tray 16, on the other hand, the stocked paper having a copy on one side thereof is sequentially sent out by the discharge roller 28. This paper again comes up to the transfer device 6, and the document image is transferred to the back side thereof. Then, the image is fixed by the thermal fixing device 13, the paper is sent to the discharge roller 15 by the changeover pawl 14 and is sequentially discharged into the sorter 2.

For example, when sorting into the leftmost sorter 2, the paper is brought to the leftmost sorter 2 by the function of the changeover pawls 19, 18, 19, 18, 19, and is sorted out onto each bin tray 21 by the belt 20 of the sorter 2.

When the final paper is sent into the sorter 2 by the discharge roller 15, immediately or from some time before, the copier 1 starts copying the next document in order to achieve high speed copying. The subsequent copying operation is as mentioned above.

Suppose the eighth sheet 30 gets into the leftmost sorter 2, with the ninth and tenth sheets present (not shown) in the upper conveying route 29, and the eighth sheet 30 becomes jammed. In this case, at this moment, at the copier 1, the next document is already being copied as mentioned above, and the paper may be on the way to the intermediate tray 16 after finishing the transfer of the copy to one side, for example.

In this case, the CPU 24 first detects jamming by receiving the output signals from the sensors S1, S2 in the leftmost sorter 2. That is, after the paper passes through the sensor S2, if the passing signal is not issued from the sensor S1 within a specified time, it may be judged that the paper is jammed. The sensor S1 moves to the position of the discharging bin tray. Accordingly, the CPU 24 issues a signal for stopping the driving of the belt 20 of the sorter 2 through the driver 23. As a result, the sorter 2 stops sorting. At the same time, the CPU 24 instructs the conveying roller 9 through the driver 23 to drive the paper going toward the intermediate tray 26 to continue to the tray 16 and to stock the paper. The driver 23 also signals that the feeding of new paper from the paper feed means 11 should be stopped. Finally, the jam display means (now shown) on the operation panel is driven to show a jam message.

The operator, reading the jam message, removes the jammed paper from the sorter 2. At this moment, the document which was put on the contact glass by the ADF 3 is removed, and the preceding document is put on the contact glass again.

When the jam is cleared by the operator, the CPU 24 discharges the one-side copied sheet in the intermediate tray 16 through the discharge roller 28, and further discharges it through the conveying route 10 by merely passing it through the transfer device 6, separator 7, thermal fixing device 13 and discharge roller 15. The discharged paper from the intermediate tray 16 is sent out to the tray 17 above the bin trays 21, for example, at the rightmost sorter 2 by selection of the changeover pawls 19, 18. This paper is discarded.

The CPU 24 recognizes the completion of the discharge of the one-side copied paper from the intermediate tray 16 by the sensor P, and displays the copy ready OK state on the operation panel after completion.

The operator, observing the display, starts copying the previously jammed paper. At this time, the one-side copied paper of the next document is not left in the intermediate tray 16, and hence there is no risk of mixing.

In this way, the subsequent documents are copied on both sides and sorted.

Incidentally, the timing of issuing the copy ready OK display may be after the final paper to be discarded passes through the transfer device 6, instead of after it is discharged. Alternatively, the copy ready signal may be at any other timing, as long as when copying is resumed and the new paper from the paper feed means 11 is moving toward the transfer device 6, the final paper to be discarded is not conveyed later than the new paper.

In the foregoing embodiment, the first document and second document are explained, but this embodiment is not limited to the first two documents. Needless to say, the same holds true with other documents, too.

Incidentally, in this embodiment, jamming took place within the sorter, but it is not limited thereto. For example, if jamming occurs in the copier main body, or in particular, if jamming occurs somewhere in the long distance between the changeover pawl 14 and discharge roller 15, this invention is applied in the same manner. It is, however, required that it is necessary to be possible to convey the paper into the intermediate tray while clearing the jam in the vicinity of the discharge roller 15.

The image forming apparatus of the invention is not limited to two-side copying, but may be applied anywhere using the intermediate tray 16, such as synthetic copying. It is not limited to the copier, of course, but it may be applied to a printer and other image forming apparatuses.

The post-processing device of the invention is not limited to a sorter, but may include a stapler and other postprocessing devices.

The jam detecting means of the invention is a sensor in the above embodiment, but a jam may be also detected by other means.

The control means of the invention may be realized either in software by using a computer, or in hardware by using a special circuit having the equivalent function.

As explained herein, the image forming apparatus with the intermediate tray of the present invention, comprises: paper feeding means for feeding a paper, conveying means for conveying the paper, image forming means for image forming using an intermediate tray, a post-processing device for post-processing a paper with an image formed thereon, jam detecting means for detecting the jamming of the paper, control means for controlling in such a manner that if the paper being conveyed is jammed along its way, for example, on its way to a post-processing device, on which paper an image of a preceding document of a specific document is formed, while a new paper is fed from the paper feeding means for the specific document and is being sent into the intermediate tray by the conveying means, a conveyance of the jammed paper by the conveying means is stopped, and the paper moving toward the intermediate tray is allowed to be conveyed to the intermediate tray and stocked, while the feeding of a new paper by the paper feeding means is stopped. When the jam is cleared, the paper stocked in the intermediate tray is discharged outside of the image forming apparatus. Therefore, the present invention has such merits that it is only necessary to remove the really jammed paper to eliminate the jam.

We claim:

1. An image forming apparatus comprising:

paper feeding means for feeding a paper, conveying means for conveying the paper, image forming means for forming an image, said image forming means including an intermediate tray, post-processing device for post-processing the paper with the image formed thereon, jam detecting means for detecting a jamming of the paper, wherein the jam detecting means detects jams which occur downstream from a switching point, wherein the switching point is located at a point wherein the paper either travels to said intermediate tray or to said post-processing device, control means for controlling the image forming apparatus such that if a paper being conveyed having an image of a first document is jammed during conveyance to the post-processing device while a second paper having an image of a second document on one side thereof is fed from the paper feeding means and is sent to the intermediate tray by the conveying means, when the conveyance of the jammed paper by the conveying means is stopped, and the second paper being conveyed toward the intermediate tray is allowed to be conveyed to the intermediate tray and stocked, while feeding of additional paper by the paper feeding means is stopped, and when the jam is cleared, the second paper stocked in the intermediate tray is discharged outside of the image forming apparatus without forming an image on a reverse side of the second paper.

2. An image forming apparatus in accordance with claim 1, wherein said post-processing device is a sorter.

3. An image forming apparatus in accordance with claim 1, wherein the image forming apparatus has two-sided copying capability.

4. An image forming apparatus in accordance with claim 1, further comprising:

display means for issuing a copy ready display after the second paper to be discharged outside of said image forming apparatus has passed through a transfer device of the image forming apparatus.

* * * * *